US008132653B2

(12) United States Patent
Flynn

(10) Patent No.: US 8,132,653 B2
(45) Date of Patent: Mar. 13, 2012

(54) CONTROLLING ELEVATOR DOOR ORIENTATION DURING DOOR MOVEMENT

(75) Inventor: Michael P. Flynn, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 710 days.

(21) Appl. No.: 11/995,582

(22) PCT Filed: Jul. 21, 2005

(86) PCT No.: PCT/US2005/025936

§ 371 (c)(1),
(2), (4) Date: Jan. 14, 2008

(87) PCT Pub. No.: WO2007/018488

PCT Pub. Date: Feb. 15, 2007

(65) Prior Publication Data

US 2008/0202860 A1 Aug. 28, 2008

(51) Int. Cl.
*B66B 13/14* (2006.01)

(52) U.S. Cl. ..... 187/316; 187/313; 187/315

(58) Field of Classification Search ..... 187/313, 187/315, 316

See application file for complete search history.

(56) References Cited

U.S. PATENT DOCUMENTS 3,533,188 A * 10/1970 Griffith et al. ..... 49/360
4,674,231 A * 6/1987 Radek et al. ..... 49/118
4,876,765 A * 10/1989 Karita ..... 16/102
5,174,417 A 12/1992 Pilsbury
5,373,120 A * 12/1994 Barrett et al. ..... 187/316
5,380,095 A * 1/1995 Pryor ..... 384/8
5,612,518 A * 3/1997 Jaminet et al. ..... 187/316
5,668,355 A * 9/1997 Jaminet et al. ..... 187/316
5,736,693 A * 4/1998 Piech et al. ..... 187/316
6,742,631 B2 * 6/2004 Grundmann ..... 187/315
6,943,508 B2 * 9/2005 Morris et al. ..... 318/38
7,019,421 B1 * 3/2006 Hall et al. ..... 310/12.11

(Continued)

FOREIGN PATENT DOCUMENTS

EP 741224 A1 * 11/1996

(Continued)

OTHER PUBLICATIONS

Machine translation of JP 10096365 A.*

(Continued)

*Primary Examiner* — Walter Benson
*Assistant Examiner* — Kawing Chan
(74) *Attorney, Agent, or Firm* — Carlson, Gaskey & Olds PC

(57) ABSTRACT

An elevator door assembly (20) includes a positioner (30) for controlling an orientation of an elevator door panel (22) during movement between open and closed positions. The positioner (30) biases the door in a direction generally perpendicular to the desired direction of door movement. The disclosed example includes a first positioner member (32) that remains in a fixed position. A second positioner member (34) is supported for movement with the elevator door (22). In disclosed examples, at least one of the positioner members (32, 34) provides a magnetic field that results in the biasing force. In a disclosed example, opposing polarities on permanent magnets are arranged to provide a repulsive force between the positioner members (32, 34), which provides the biasing force on the elevator door.

22 Claims, 2 Drawing Sheets

U.S. PATENT DOCUMENTS

| | | | | |
|---|---|---|---|---|
| 2003/0037996 | A1 | 2/2003 | Yamamoto et al. | |
| 2003/0110696 | A1 | 6/2003 | Rennetaud et al. | |
| 2003/0221374 | A9* | 12/2003 | Zhou et al. | 52/30 |
| 2004/0124038 | A1* | 7/2004 | Wesson et al. | 187/334 |
| 2008/0271959 | A1* | 11/2008 | Gieras et al. | 187/331 |

FOREIGN PATENT DOCUMENTS

JP 10096365 A * 4/1998

OTHER PUBLICATIONS

International Preliminary Examination Report for International application No. PCT/US05/25936 mailed Aug. 24, 2007.
International Search Report for International application No. PCT/US05/25936 mailed Jan. 11, 2007.
Written Opinion of the International Searching Authority for International application No. PCT/US05/25936 mailed Jan. 11, 2007.

* cited by examiner

CONTROLLING ELEVATOR DOOR ORIENTATION DURING DOOR MOVEMENT

FIELD OF THE INVENTION

This invention generally relates to elevator systems. More particularly, this invention relates to elevator doors.

DESCRIPTION OF THE RELATED ART

Elevator systems typically include a cab that moves within a hoistway to carry passengers, cargo or both between various levels in a building. The cab typically includes doors that are closed during cab movement and open to provide access to the cab or a landing as desired. Each landing typically includes a hoistway door that moves with the doors supported on the cab when the doors are appropriately positioned relative to each other.

A variety of mechanisms for supporting doors in elevator systems are known. Typical arrangements include a track near a top of the door and a set of rollers that roll along the track. The weight of the door typically is supported by the rollers so that the rollers follow the track as the door moves between open and closed positions.

As elevator doors have become lighter and are moved faster, there is a tendency for vertical movement of the door in a so-called up thrust direction while the doors is being moved in a horizontal direction between the open and closed positions. Such vertical movement is undesirable because it introduces noise and the possibility for rollers to move off of the track. It is desirable to have smooth horizontal movement of doors in an elevator system.

One attempt at addressing up thrust movements has been to add a second set of rollers or a second track. In the first instance, the second set of rollers are positioned to contact a track from underneath to resist upward movement of the door while the main rollers contact a track from above to facilitate the desired movement of the door. With an additional track, the main rollers are essentially trapped between an upper track and a lower track to avoid vertical movements of the doors.

Such approaches introduce additional parts and material cost. Moreover, such approaches require precise adjustment which introduces additional time and labor expenses during installation and routine maintenance procedures.

There is a need for an economical and reliable arrangement for controlling the orientation of an elevator door during door movement. This invention addresses that need.

SUMMARY OF THE INVENTION

An exemplary disclosed device for controlling movement of an elevator door includes a positioner that provides a biasing force to bias an elevator door in a direction that is generally perpendicular to a direction of desired elevator door movement.

In one example, the biasing force results from a magnetic field.

In one example, the positioner includes at least one magnet. At least one other magnet is associated with the elevator door so that the polarities of the magnets provide the biasing force on the door. In one preferred example, the polarities are arranged so that the magnets repel each other. In another example the magnets are arranged so that they attract each other.

One example includes using a ferromagnetic member and a magnet, wherein the biasing force is an attractive force between the magnet and the ferromagnetic member.

An exemplary disclosed method of controlling an orientation of an elevator door includes magnetically biasing the door into a desired orientation relative to a desired direction of door movement.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENTS

Figure 1:
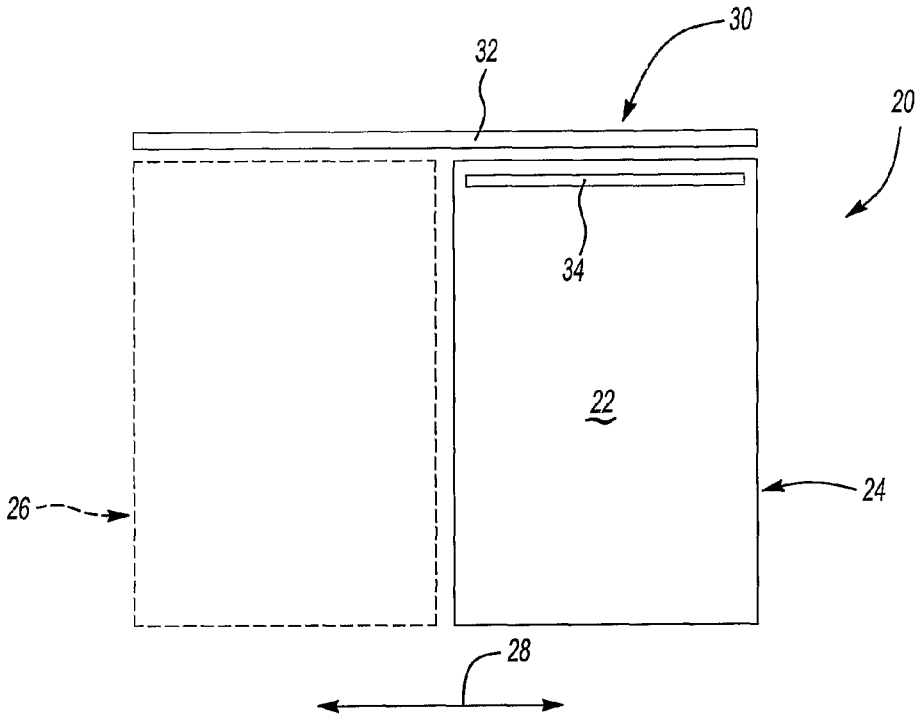
FIG. 1 schematically illustrates selected portions of an elevator door assembly including a positioner designed according to an embodiment of this invention.

FIG. 1 schematically shows selected portions of an elevator door assembly 20. At least one door panel 22 is moveable between an open position shown at 24 and a closed position shown in phantom at 26. A direction of elevator door movement is schematically shown by the arrows 28. The direction of door movement in the Figure is horizontal.

The example assembly 20 includes a positioner 30 for orienting the door panel 22 during desired movement of the elevator door panel 22. The positioner 30 provides a biasing force that biases the door panel 22 into a desired orientation. In the illustrated example, the positioner 30 biases the door panel 22 in a vertical direction, which is generally perpendicular to the desired direction of door movement as shown by the arrow 28. In the example of FIG. 1, the positioner 30 biases the door panel 22 downward (according to the drawing) to facilitate proper operation of components associated with supporting the door panel 22 for the desired movement.

In one example, the positioner 30 includes a first positioner member 32 in a fixed position relative to the assembly 20. The first positioner member 32 may be supported, for example, in a fixed position relative to a header associated with an elevator car frame or a hoistway door frame.

In one example, the first positioner member 32 comprises a permanent magnet. As schematically shown in FIG. 1, the first positioner member 32 has a length that corresponds to a distance traveled by the door panel 22 as it moves between the open and closed positions 24 and 26. In one such example, the first positioner member 32 comprises a plurality of magnets aligned adjacent each other. Another example includes a single, elongated magnetic strip.

The illustrated example includes a second positioner or member 34 that is supported for movement with the door panel 22. The second positioner member 34 may be fixed to the door panel 22 or to another component that remains fixed relative to the door panel, for example. In one example, the second positioner member 34 comprises at least one permanent magnet. In another example, the second positioner member 34 comprises a ferromagnetic member.

Interaction between the first positioner member 32 and the second positioner member 34 provide the biasing force for biasing the door panel 22 into the desired orientation.

Figure 2:
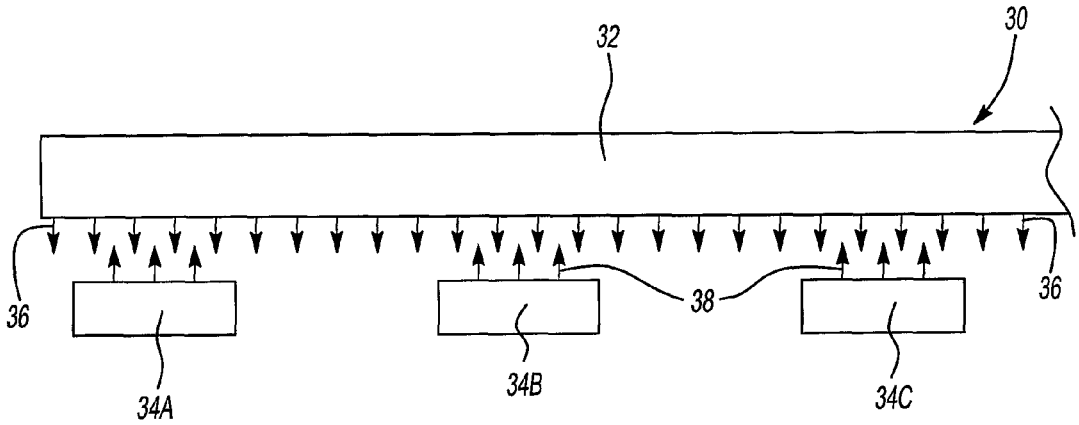
FIG. 2 schematically illustrates a biasing force of one example positioner arrangement.

In one example, the first positioner member 32 and the second positioner member 34 each comprise a permanent magnet. The polarities of the permanent magnets are arranged to provide a desired interaction between them resulting in the desired biasing force. FIG. 2 schematically shows one arrangement that includes a second positioner member comprising a plurality of magnets 34A, 34B and 34C. In this example, the first positioner member 32 comprises a permanent magnet. A magnetic field 36 of the first positioner member 32 is arranged to cooperate with a magnetic field 38 of the second positioner members 34 such that they repel each other and the positioner members are urged away from each other. Because the first positioner member 32 is in a fixed position, the reaction between the magnetic fields 36 and 38 results in the second positioner members 34A-34C being biased downward (according to the drawings), which biases the door in the same direction. In one example, this is accomplished by using the same polarities on the permanent magnets facing each other.

Figure 3:
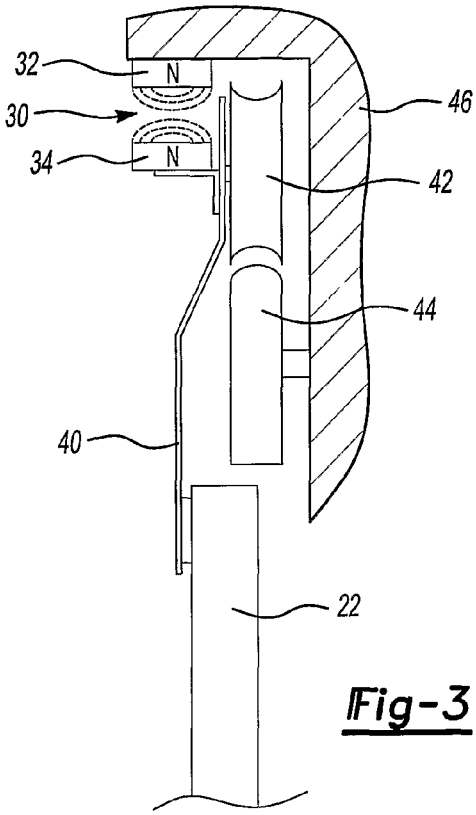
FIG. 3 is a side view schematically showing one example embodiment.

FIG. 3 schematically shows one example arrangement where permanent magnets are used as the first positioner member 32 and the second positioner member 34. In this example, each magnet has its north pole facing the other magnet resulting in a repulsive force between them. The repulsive force provides the biasing force for biasing the door panel 22 into the desired orientation. In the example of FIG. 3, the door panel 22 is supported on a door hanger 40. A roller 42 is associated with the door hanger 40 in a known manner. The roller 42 follows along a track 44. A header 46 supports the track 44 in a known manner and remains fixed relative to an elevator car frame or a hoistway door frame as known. The repulsive force between the first positioner member 32 and the second positioner member 34 will bias the roller 42 toward engagement with the track 44. The same force resists upward movement of the door panel 22 which would tend to cause the roller 42 to move upward and away from the track 44. The repulsive force between the permanent magnets of the first positioner member 32 and the second positioner member 34, therefore, orients the door 22 and biases the door panel 22 in a desired direction as the door panel moves between open and closed positions.

One advantage to the example of FIGS. 2 and 3 is that the magnets may be spaced such that the repulsive force does not force the roller 42 onto the track 44 when the door is properly oriented. Instead, the repulsive force only has an effect if the door panel and roller 42 move upward, which moves the magnets closer together. Such an arrangement allows for the normal desired level of engagement between the roller 42 and the track 44 while introducing an appropriate biasing force to avoid undesired upward movement of the door panel 22, for example. The strength and spacing of the magnets can be selected to achieve a desired performance. Given this description, those skilled in the art will be able to select what will best meet their particular needs.

Figure 4:
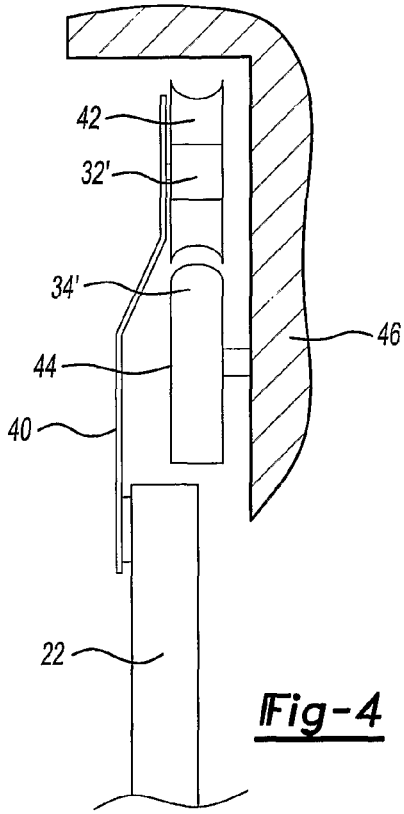
FIG. 4 is a side view of another embodiment.

FIG. 4 schematically shows another example embodiment where the first positioner member 32' is incorporated into the roller 42. In this example, the first positioner member 32' comprises a permanent magnet. The second positioner member 34' comprises at least a portion of the track 44 made of a ferromagnetic material. An attractive force between the permanent magnet of the first positioner member 32' and the ferromagnetic portion of the track 44 (i.e., the second positioner member 34') biases the roller 42 into engagement with the track 44. The same force effectively biases the door panel 22 in a direction generally perpendicular to the direction of the door movement. The example of FIG. 4 shows one arrangement where an attractive, magnetic force between two positioner members biases the door panel 22 into a desired orientation during movement of the door.

Figure 5:
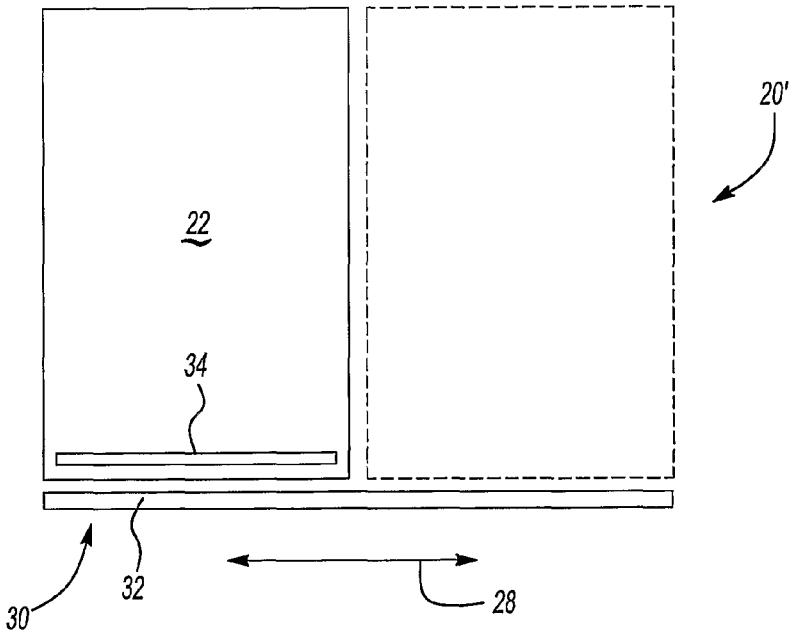
FIG. 5 schematically shows selected portions of an elevator door assembly including another embodiment of a positioner designed according to this invention.

FIG. 5 schematically shows another arrangement where the positioner 30 is supported near a bottom of the door panel 22. In this example, the first positioner member 32 remains in a fixed position relative to the elevator car frame or a hoistway door frame, for example. The second positioner member 34 moves with the door panel 22 as the door panel moves between open and closed positions. In this example, a magnetic force urges the second positioner member 34 toward the first positioner member 32 to bias the door panel 22 in a direction generally perpendicular to the desired direction of door movement. One use for such an embodiment is where the door panel 22 is suspended from above using a known roller and track arrangement. The attractive force between the first positioner member 32 and the second positioner member 34 near the bottom of the door panel 22 tends to maintain the door in a desired horizontal orientation throughout door movement.

In another example designed according to the embodiment of FIG. 5, the positioner 30 near the bottom of the door panel 22 utilizes a repulsive force between two magnets to achieve the desired door position control during door movement.

The disclosed examples show how a biasing force can be introduced into an elevator door assembly for biasing the door in a direction generally perpendicular to a desired direction of door movement. The repulsive biasing force is preferred in some situations to avoid undesirably forcing a roller against a track, for example.

The biasing force in the disclosed examples results from a magnetic field associated with at least one magnet. Other ways of accomplishing a biasing force for controlling door movement and door position may become apparent to those skilled in the art who have the benefit of this description that do not involve a permanent magnet, for example. Accordingly, this invention is not necessarily limited to the disclosed examples.

One advantage to the disclosed examples is that the biasing force for controlling the orientation of an elevator door does not rely on any contact between components so that precise alignment and wear issues are avoided. As can be appreciated from the above description, the disclosed examples provide an economic solution to the problem of avoiding up thrust movements of an elevator door during desired movement between open and closed positions.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator door assembly, comprising:

a track aligned with a desired direction of door movement;

at least one elevator door;

at least one mover associated with the elevator door, the mover being moveable along the track; and a positioner device located near a top of the door that provides a biasing force to bias the door into a desired orientation by biasing the door in a downward direction that is generally perpendicular to the desired direction of door movement to thereby avoid upward movement of the door.

2. The assembly of claim 1, wherein the biasing force results from a magnetic field.

3. The assembly of claim 1, wherein the positioner comprises at least one magnet.

4. The assembly of claim 3, wherein the at least one magnet is in a fixed position relative to the elevator door, the positioner comprises at least one second magnet that moves with the elevator door and the at least one magnet and the at least one second magnet have polarities arranged such that the magnets cooperate to provide the biasing force.

5. The assembly of claim 3, wherein the at least one magnet has a length that corresponds to a distance of travel associated with the desired elevator door movement.

6. The assembly of claim 3, wherein the positioner comprises at least one ferromagnetic member.

7. The assembly of claim 1, wherein the positioner is associated with an end of the door that is closest to the track.

8. The assembly of claim 7, comprising a header in a fixed position relative to the track and a door hanger associated with the door for suspending the door from the track and wherein the positioner comprises at least one magnet supported on one of the header or the door hanger.

9. The assembly of claim 8, comprising a second magnet supported on the other of the header or the door hanger and wherein the at least one magnet and the second magnet have polarities aligned to bias the door hanger in a selected direction relative to the header.

10. The assembly of claim 9, wherein the at least one first magnet and the second magnet polarities result in the biasing force comprising an attractive force between the magnets.

11. The assembly of claim 10, wherein the positioner is associated with an end of the door that is opposite from an end near the track.

12. The assembly of claim 1, wherein the at least one mover comprises rollers that move along the track as the door moves in the desired direction and wherein the positioner device biases the rollers toward the track.

13. The assembly of claim 1, wherein the positioner comprises at least one magnet having a length corresponding to a length of the track.

14. The assembly of claim 1, wherein the positioner device is arranged to continuously bias the at least one mover into engagement with the track.

15. The assembly of claim 1, wherein the biasing force tends to urge the at least one mover into engagement with the track.

16. An elevator door assembly, comprising:

a track aligned with a desired direction of door movement;

at least one elevator door;

at least one mover associated with the elevator door, the mover being moveable along the track; and a positioner device that provides a biasing force to bias the door into a desired orientation by biasing the door in a downward direction that is generally perpendicular to the desired direction of door movement to thereby avoid upward movement of the door, the positioner comprising at least one first magnet in a fixed position relative to the track and at least one second magnet that moves with the elevator door and the at least one first magnet and the at least one second magnet have polarities arranged such that the magnets cooperate to provide the biasing force comprising a repulsive force between the magnets.

17. A method of controlling an orientation of an elevator door, comprising:

situating an elevator door and a mover associated with the elevator door for movement along a track; and situating a positioner device near a top of the door for magnetically biasing the door in a downward direction into a desired orientation relative to a desired direction of door movement to thereby avoid upward movement of the door.

18. The method of claim 17, comprising continuously biasing the mover into engagement with the track.

19. The method of claim 17, comprising biasing the mover into engagement with the track.

20. A method of controlling an orientation of an elevator door, comprising:

situating an elevator door and a mover associated with the elevator door for movement along a track; and using a repulsive force associated with a magnetic field for magnetically biasing the door in a downward direction into a desired orientation relative to a desired direction of door movement to thereby avoid upward movement of the door.

21. A method of controlling an orientation of an elevator door, comprising:

situating an elevator door and a mover associated with the elevator door for movement along a track;

magnetically biasing the door in a downward direction into a desired orientation relative to a desired direction of door movement to thereby avoid upward movement of the door; and selectively biasing the mover toward engagement with the track only in response to movement of the mover away from the track.

22. An elevator door assembly, comprising:

a track aligned with a desired direction of door movement;

at least one elevator door;

at least one mover associated with the elevator door, the mover being moveable along the track; and a positioner device that provides a biasing force to bias the door into a desired orientation by biasing the door in a downward direction that is generally perpendicular to the desired direction of door movement to thereby avoid upward movement of the door, wherein the positioner is arranged to selectively bias the at least one mover into engagement with the track only in response to movement of the mover away from the track.

* * * * *